US006352255B1

(12) United States Patent
Taylor

(10) Patent No.: US 6,352,255 B1
(45) Date of Patent: Mar. 5, 2002

(54) REVERSING SHUTTLE FEEDER

(75) Inventor: Thomas N. Taylor, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 3 days.

(21) Appl. No.: 09/591,778

(22) Filed: Jun. 12, 2000

(51) Int. Cl.[7] ..... B65H 3/34
(52) U.S. Cl. ..... 271/104; 271/105; 271/107
(58) Field of Search ..... 271/104, 105, 271/106, 107

(56) References Cited

U.S. PATENT DOCUMENTS 3,466,028 A * 9/1969 Bays
3,879,031 A * 4/1975 Melehan ..... 271/104 X
5,785,301 A * 7/1998 Halup et al. ..... 271/106 X

* cited by examiner

*Primary Examiner*—David H. Bollinger
(74) *Attorney, Agent, or Firm*—Lloyd Bean, II

(57) ABSTRACT

A sheet feeding apparatus for feeding a compilation of sheets in a direction of movement to a process station, comprising: a sheet tray for holding said compilation of sheets; an air plenum, positioned above said compilation of sheets, for picking up sheets into contact with said air plenum when a vacuum force is applied; drive means, attached to said air plenum, for translating said air plenum initially in a direction reverse from the direction of movement so that a trailing edge of said one of said compilation of sheets abuts against a portion of said sheet tray to generate a buckle area in said one of said compilation of sheets thereby allowing separation of one of said compilation of sheets from other sheets in said compilation of sheets, and said drive means translates said one of said compilation of sheets in said direction of movement.

2 Claims, 13 Drawing Sheets

REVERSING SHUTTLE FEEDER

FIELD OF THE INVENTION

This invention relates generally to an electronic reprographic printing system, and more particularly concerns feeder apparatus process for improving feeding of compilations of recording sheets that often accompanies this general method of reproduction and printing.

BACKGROUND OF THE INVENTION

Cross reference is made to the following applications filed concurrently herewith: U.S. patent application Ser. No. 09/591,820 entitled "A Sheet Feeding Apparatus Having An Air Plenum With A Corrugated Surface", U.S. patent application Ser. No. 09/591,822 entitled "A Sheet Feeding Apparatus Having An Air Plenum With A Seal", U.S. patent application Ser. No. 09/591,909 entitled "A Sheet Feeding Apparatus Having An Air Plenum With A Leaky Seal", and U.S. Pat. No. 6,264,188 entitled "A Sheet Feeding Apparatus Having An Adaptive Air Fluffer".

In the process of electrostatographic reproduction, a light image of an original to be copied or printed is typically recorded in the form of a latent electrostatic image upon a photosensitive member, with a subsequent rendering of the latent image visible by the application of electroscopic marking particles, commonly referred to as toner. The visual toner image can be either fixed directly upon the photosensitive member or transferred from the member to another support medium, such as a sheet of plain paper. To render this toner image permanent, the image must be "fixed" or "fused" to the paper, generally by the application of heat and pressure.

With the advent of high speed xerography reproduction machines wherein copiers or printers can produced at a rate in excess of three thousand copies per hour, the need for sheet handling system to, for example, feed paper or other media through each process station in a rapid succession in a reliable and dependable manner in order to utilize the full capabilities of the reproduction machine. These sheet handling systems must operate flawlessly to virtually eliminate risk of damaging the recording sheets and generate minimum machine shutdowns due to misfeeds or multifeeds. It is in the initial separation of the individual sheets from the media stack where the greatest number of problems occur which, in some cases, can be due to up curl and downcurl in sheets which generally occur randomly in the document stack.

SUMMARY OF THE INVENTION

There is provided a sheet feeding apparatus for feeding a compilation of sheets in a process direction to a process station, comprising: a sheet tray for holding said compilation of sheets; an air plenum, positioned above said compilation of sheets, said plenum including a corrugated surface having a first set of ribs at a first height and a second set of ribs at a second height; and a blower for generating a vacuum force in said air plenum to drive one of said compilation of sheets into contact with said corrugated surface.

An object of the present invention is a sheet feeder apparatus. In this apparatus, air is used to help sheet separation, fluff sheet up, acquire sheet from the media tray and remove extra sheets away from the sheet being fed.

DETAILED DESCRIPTION OF THE INVENTION

Figure 1:
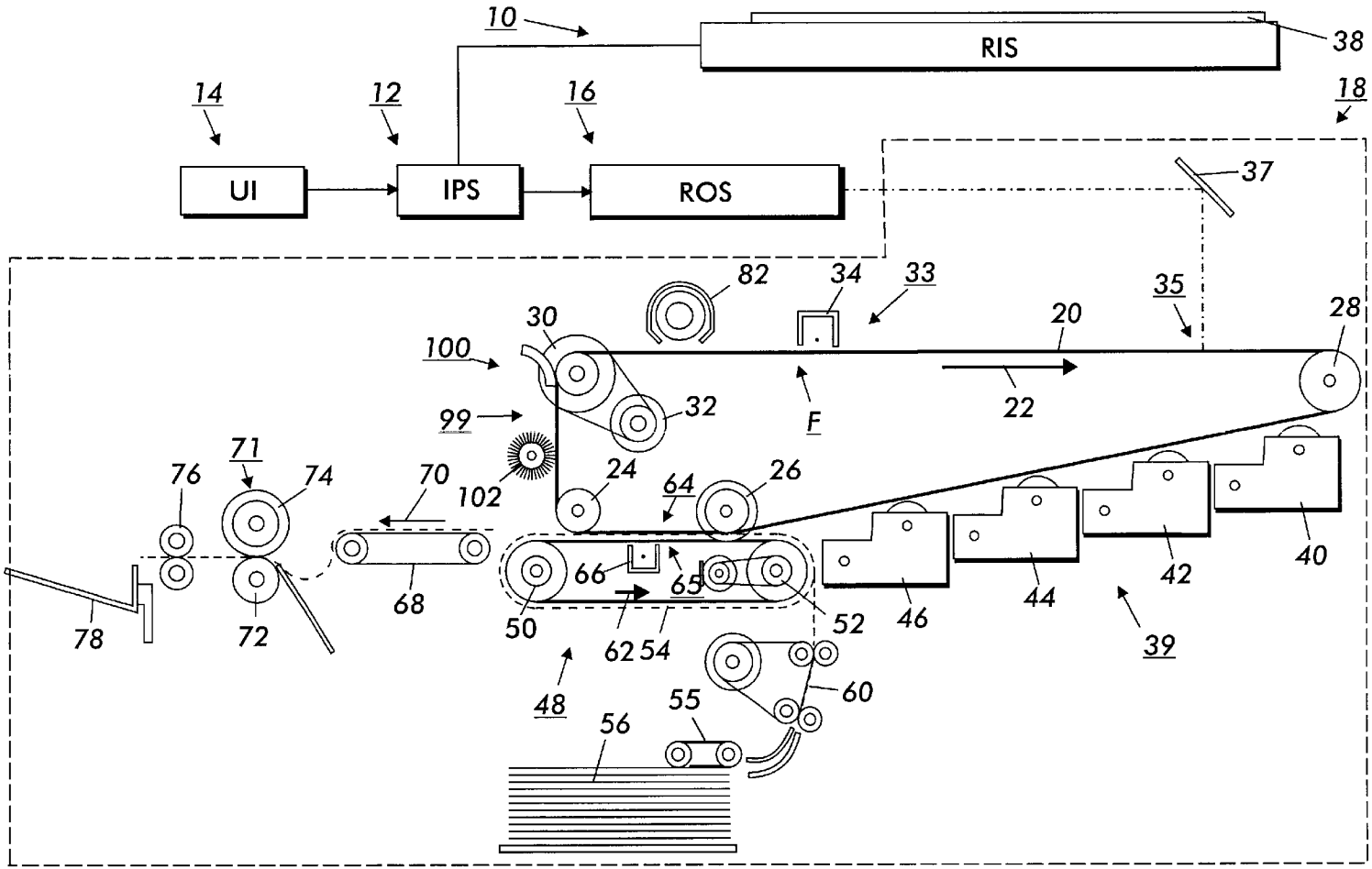
FIG. 1 is a schematic elevational view of an illustrative electrophotographic printing having the features of the present invention therein.
Figure 2:
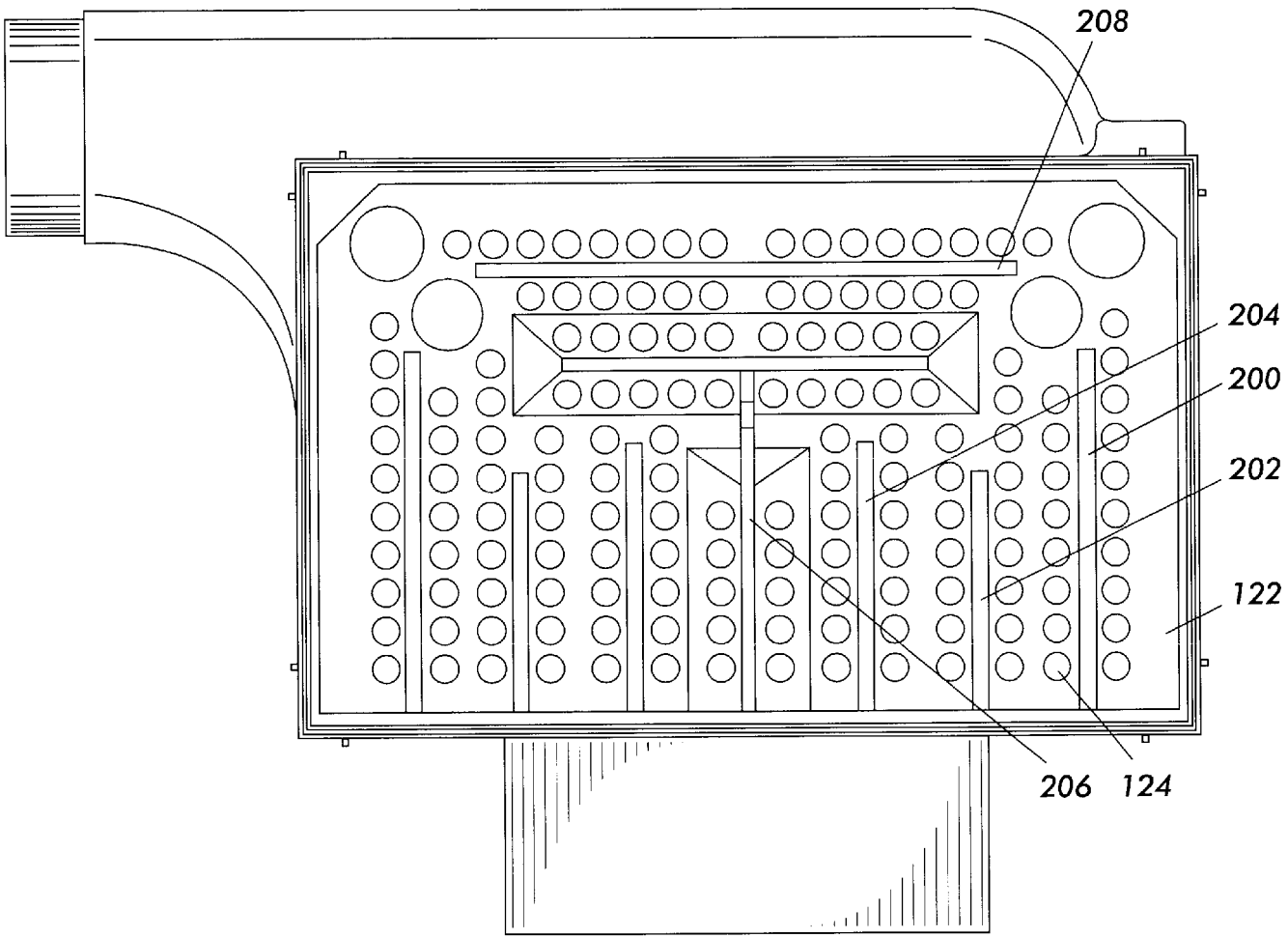
FIGS. 2 and 3 are bottom and air plenum of a media feeder.

While the present invention will hereinafter be described in connection with preferred embodiments, it will be understood that it is not intended to limit the invention to a particular embodiment.

For a general understanding of the features of the present invention, reference is made to the drawings. In the drawings, like reference numerals have been used throughout to designate like elements. It will become evident from the following discussion that the present invention and the various embodiments set forth herein are suited for use in a wide variety of printing and copying systems, and are not necessarily limited in its application to the particular systems shown herein.

By way of a general explanation, FIG. 1 is a schematic elevational view showing an electrophotographic printing machine which incorporates features of the present invention therein. It will become evident from the following discussion that the present invention is equally well suited for use in a wide variety of copying and printing systems, and is not necessarily limited in its application to the particular system shown herein. As shown in FIG. 1, during operation of the printing system, a color or black/white original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of calorimetric coordinates.

IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. IPS 12 then transmits signals corresponding to the desired image to ROS 16, which creates the output copy image. ROS 16 includes a laser with rotating polygon mirror blocks. Preferably, a nine facet polygon is used. ROS 16 illuminates, via mirror 37, the charged portion of a photoconductive belt 20 of a printer or marking engine, indicated generally by the reference numeral 18, at a rate of about 400 pixels per inch, to achieve a set of subtractive primary latent images. ROS 16 will expose the photoconductive belt 20 to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multicolored image on the copy sheet. This multicolored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt 20 moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having multicolored original document 38 positioned thereat. The modulated light beam impinges on the surface of photoconductive belt 20. The beam illuminates the charged portion of the photoconductive belt to form an electrostatic latent image. The photoconductive belt 20 is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44, and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface.

The color of each of the toner particles is adapted to absorb light within a preselected spectral region of the electromagnetic wave spectrum. For example, an electrostatic latent image formed by discharging the portions of charge on the photoconductive belt 20 corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the nonoperative position, the magnetic brush is spaced therefrom. (In FIG. 1, each developer unit 40, 42, 44, and 46 is shown in the operative position.) During development of each electrostatic latent image, only one developer unit is in the operative position, while the remaining developer units are in the nonoperative position. This ensures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown in FIG. 1) extends between belts 54 and moves in unison therewith. A sheet is advanced from a stack of sheets 56 disposed on a tray. A feeder 58 according to the present invention advances the uppermost sheet from stack 56 onto a pre-transfer transport 60. Transport 60 advances a sheet (not shown in FIG. 1) to sheet transport 48. The sheet is advanced by transport 60 in synchronism with the movement of the sheet gripper. In this way, the leading edge of the sheet arrives at a preselected position, i.e. a loading zone, to be received by the open sheet gripper. The sheet gripper then closes securing the sheet thereto for movement therewith in a recirculating path. The leading edge of the sheet is secured releasably by the sheet gripper. As belts 54 move in the direction of arrow 62, the sheet moves into contact with the photoconductive belt 20, in synchronism with the toner image developed thereon. In transfer zone 64, a gas directing mechanism (not shown in FIG. 1) directs a flow of gas onto the sheet to urge the sheet toward the developed toner image on photoconductive belt 20 so as to enhance contact between the sheet and the developed toner image in the transfer zone. Further, in transfer zone 64, a corona generating device 66 charges the backside of the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another.

One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multicolor copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The final processing station in the direction of movement of photoconductive belt 20, as indicated by arrow 22, is a photoreceptor cleaning station, Further details of the construction and operation of feeder station 58 of the present invention are provided below referring to FIGS. 2 through 5. The sequence of operation of the sheet feeder of the present invention is as follows. A stack of paper 56 is placed into the elevator paper tray 120.

Figure 14:
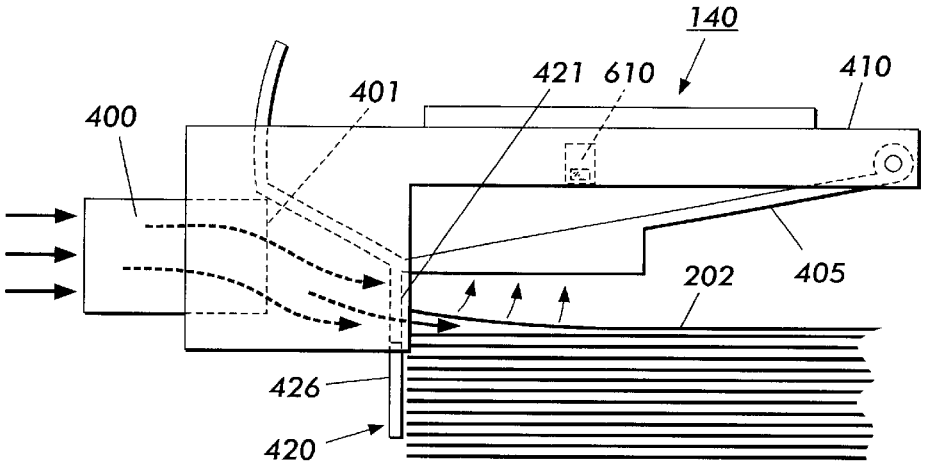
FIGS. 14 and 15 illustrate an air fluffer.
Figure 15:
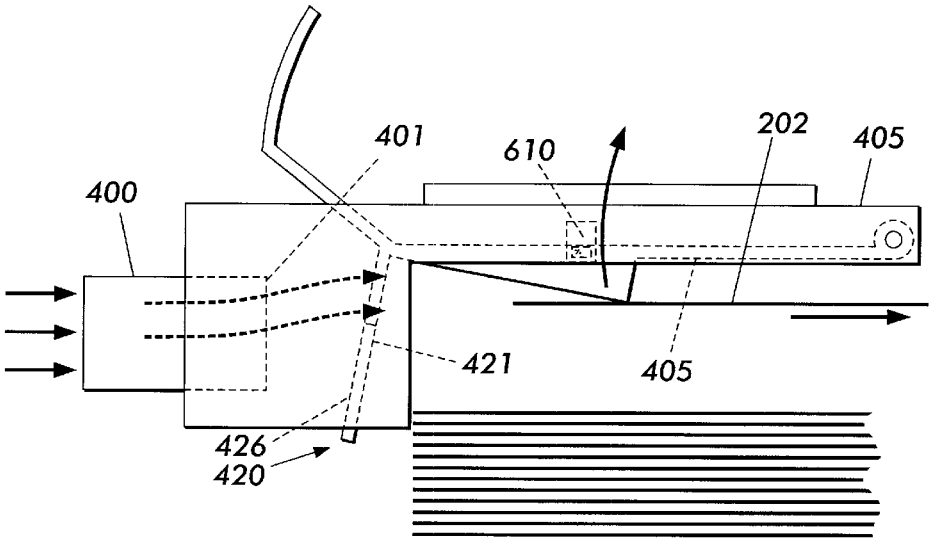

Referring to FIGS. 14 and 15, there is shown an adaptive fluffer 140. Adaptive fluffer has an air openings 401. The adaptive fluffer 140 is arranged such that it may inject air between sheets in the stack and on top surface of the sheet to be fed. The air pressure between sheets helps separate sheets, i.e. puff the sheets up. The air on top of the surface of the sheet to be fed, on the other hand, due to the Venturi effect, creates a vacuum to help pull the sheet to the feeder head. The combined effects improve the speed of the sheet acquisition speed and ensure a single sheet feed.

The fluffer consists of support structure 410 and plate 415 having a Venturi plate portion 405 and regulating plate portion 420. Regulating plate portion 420 has an area 427 which permits air to go through and a cross-section area 426 which limits air low. Before paper is fluffed, the Venturi plate portion 405 is flat against the stack of paper 56. When paper is fluffed, paper will lift up the Venturi plate portion 405. When the paper moves up, its motion will transfer to the top position 425. It in turn pivots the regulating plate of the fluffer. The pivoting motion of Venturi plate portion 405 causes a cross-section area 426 of regulating plate portion 420 to limit the airflow. The Venturi plate is angled relative to support structure 410 so that whatever height the stack is at the gap area 615 remains substantially the same. This maintains the airflow on the stack to be consistent as the stack height changes. Both of these effects regulates the amount of fluffing to prevent over fluffing and keeps paper from being packed near the top sheet of the paper. This obviates the problem of paper being packed at the top of the fluffed sheets. This problem is more acute in the regular fluffer system for lightweight paper; as it will result in multi-feeds.

When the sheet 202 is feed out of contact with Venturi plate portion 405 by feeder plenum 58. Plate 415 move back down. Venturi plate portion 405 contacts the next sheet to be fed.

Adaptive fluffer also be used for the paper stack height sensing. To do that, a sensor assembly 610 is mounted on the Venturi plate and it is used to measure the paper latitude inside the paper tray. Sensor assembly detects the change in position of Venturi plate on the stack of sheets. The reading of the paper latitude is then used to adjust the paper tray by operating the tray elevator.

Referring to FIGS. 2, 3, 4, 5, 12, and 13, feeder plenum 58 is located above the stack 56. The feeder plenum 58 includes a cavity which may be evacuated thereby forming a pressure differential. The vacuum paper contact surface 122 of the feeder plenum 58 includes a series of small openings 124.

The difference in pressure between the inside of the feeder plenum 58 and the outside of the feeder plenum 58 forces the supply paper towards the vacuum paper contact surface 122 of the feeder plenum 58 and seal 300. Vacuum paper contact surface 122 employs a corrugated surface composed of a combination of variant sized ribs to reduce the bonding forces between paper surfaces thereby separating sheets on said vacuum paper contact surface 122.

Seal 300 is positioned about the perimeter of plenum 58. Seal 300 is a floating and flexible seal between the vacuum plenum and paper stack. An advantageous feature of seal 300 is its adaptability. It bridges the gap between the vacuum plenum and the stack while not inhibiting the fluffing of the stack. Seal 300 is contoured to the out of flat conditions of the stack as sheets are drawn thereto. Seal 300 is also able to contour about the sheet as the sheet is corrugated against the vacuum plenum corrugating area. Seal 300 is sufficient rigidity to not be drawn into the vacuum plenum box.

Figure 13:
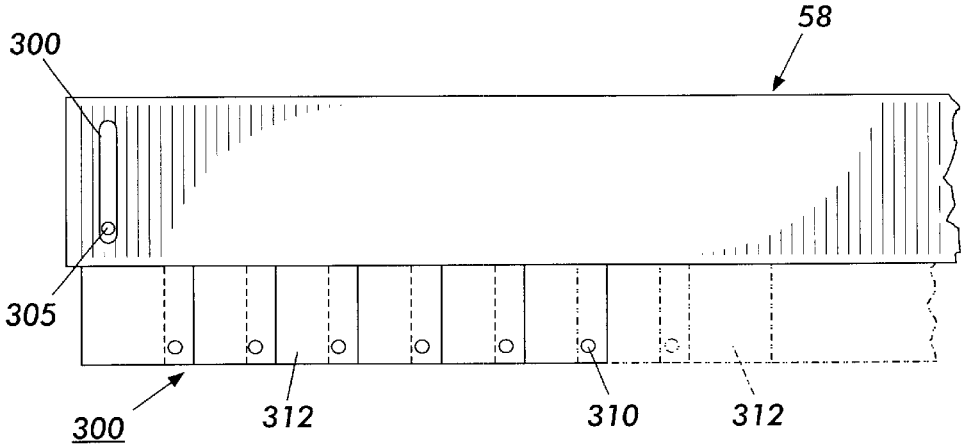

FIG. 13 shows one embodiment of seal 300. In this design, the sealing strip consists of small segments 312 flexibly connected together by pin 310. These segment 310 can freely rotate against each other in the in-plane direction, making it highly adaptable to the paper corrugation. The sealing has relatively much greater stiffness in the out-plane direction to prevent unwanted strip bending. To achieve global adaptability to the initial gap between the vacuum chamber and the paper stack, the seal 300 has relative movement to the vacuum chamber. One way to accomplish that is to hang the seal 300 to the plenum 58 through small vertical channels 306 in which seal 300 rides up and down. The small channel will guide the up-down motion. Before the vacuum is applied, the seal 300 then slides down along the channel to lay on the paper stocks due to gravity. To prevent direct contact between the seal 300 and the stack (if such a contact is not wanted), one may also put stop 305 on the channels to limit the maximum movement.

Sealing the vacuum plenum to the acquiring sheet has the added advantage that the fluffing and air knife pressure flows do not feed air into the vacuum plenum and make it difficult to create an acquiring vacuum.

Figure 4:
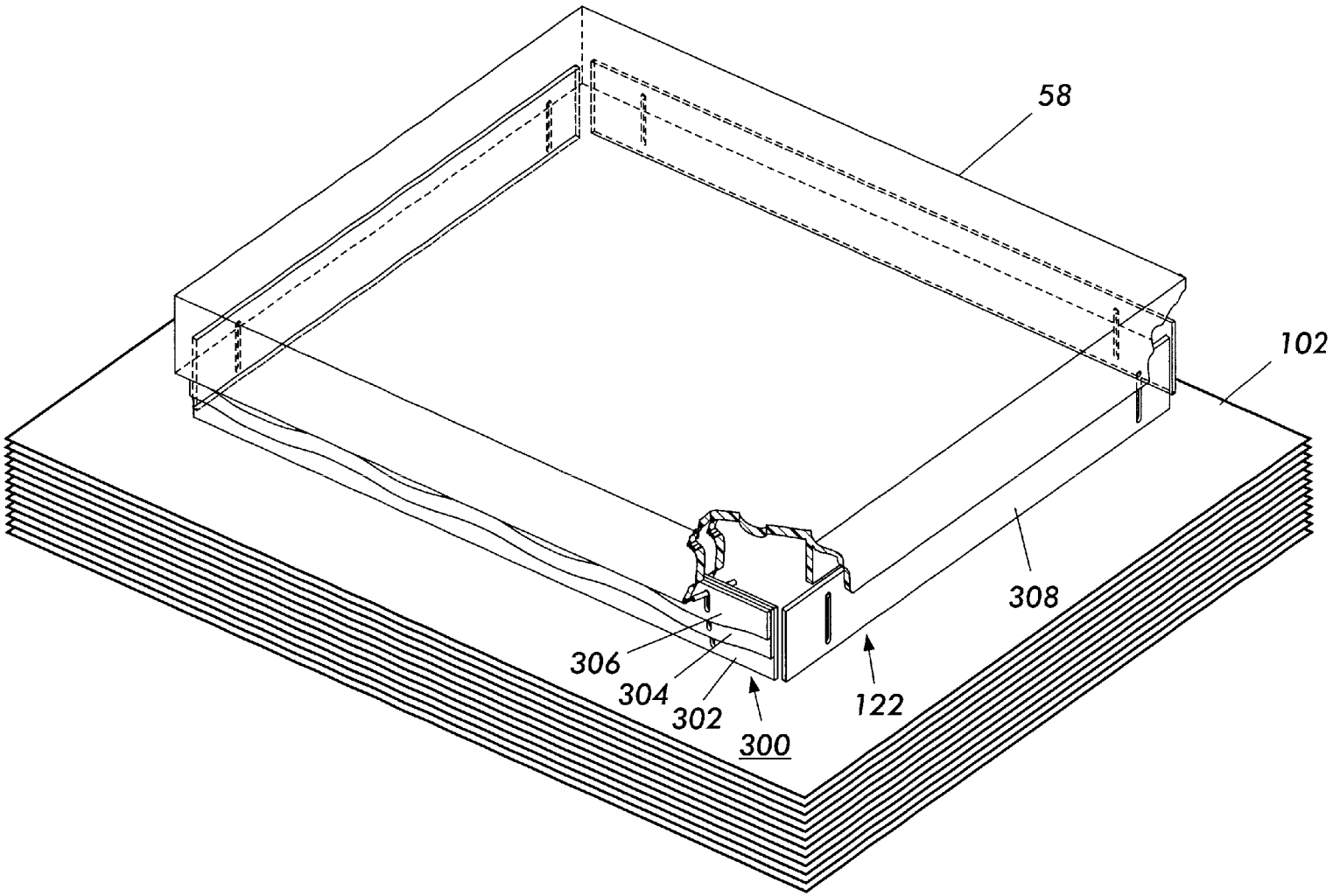
FIGS. 4 and 5 illustrate an embodiment of a seal used with the air plenum.
Figure 5:
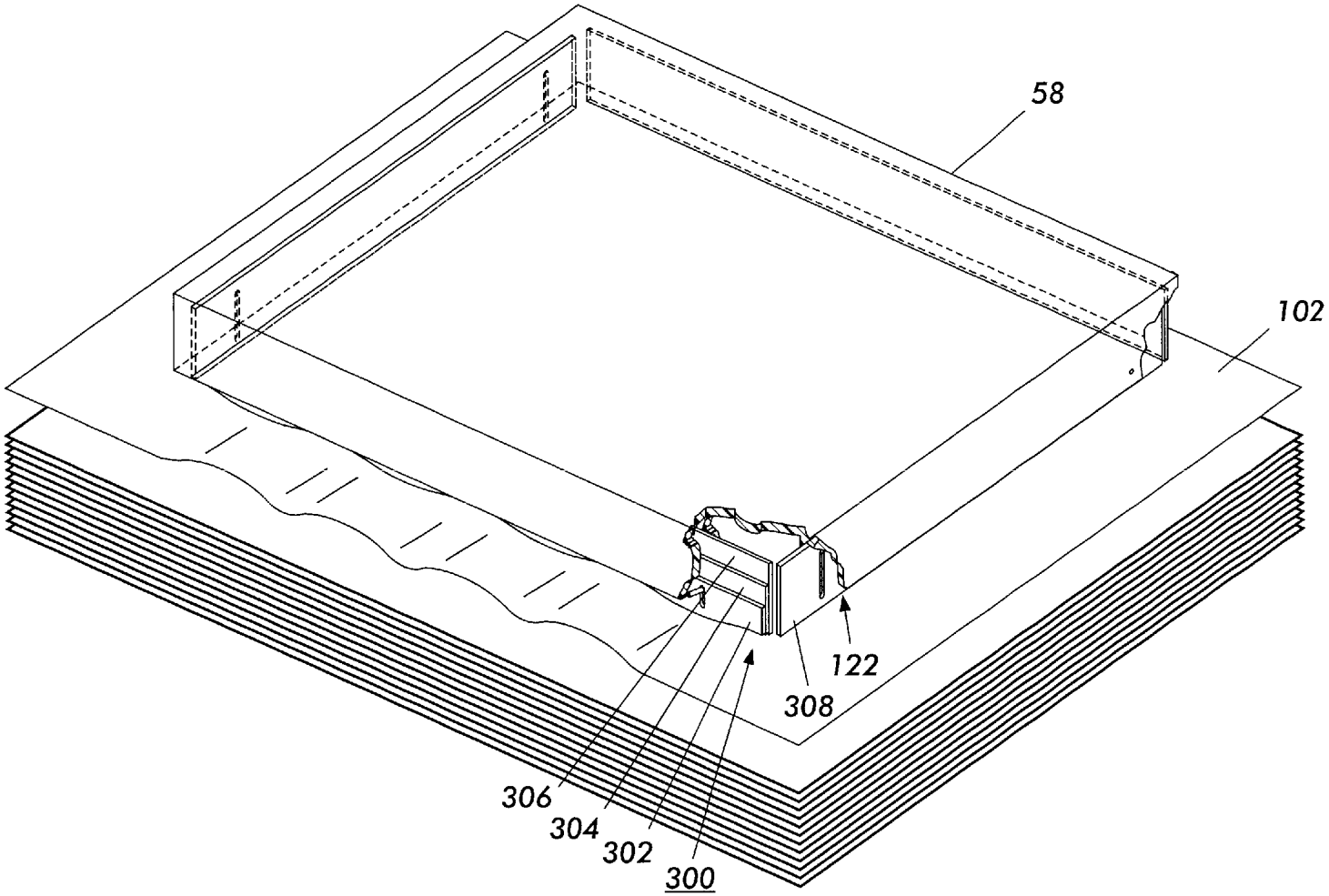

A second embodiment of seal 300 is shown in FIGS. 4 and 5, seal 300 comprising a plurality of contoured seal that fit the shape of the corrugated surface 122. The seals 302, 304, and 306 are attached to vacuum plenum perimeter through vertical channels or some other mechanisms which make the seals movable. When the plenum vacuum is turned on, the front straight seal 302 (in conjunction with the other three perimeter seals 302, 304, and 306) applies the full vacuum pressure to the flat sheet with little or no leakage. This lifts the sheet (the fluffers also assist) until it is drawn into contact with the plenum box. At this time the sheet begins to corrugate around the fixed pattern of the plenum box. Heavyweight sheets corrugate very little and lightweight sheets corrugate more. To control the plenum box pressure seals 304 and 306 are shaped to provide a controlled amount of leakage. For heavier weight sheets larger vacuums are desired and for lighter weight sheets a lower pressure is desired. The seal 304 and 306 are so contoured to engage the sheet as it progressively corrugates while providing the appropriate leakage to reduce the pressure for lighter weight sheets.

Figure 16:
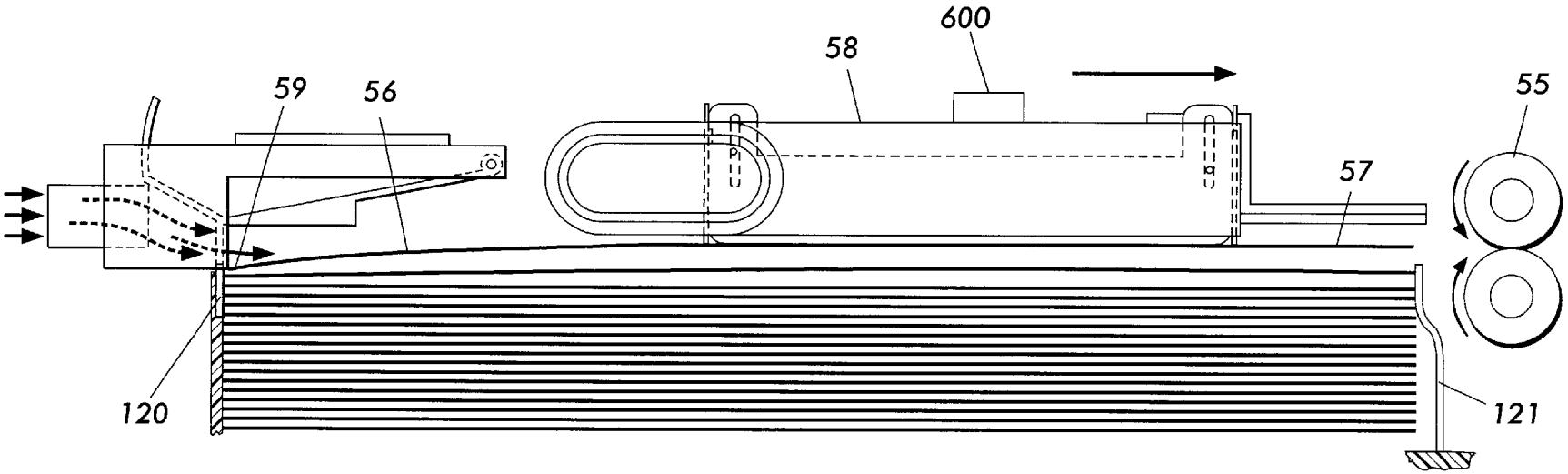
FIGS. 16, 17, and 18 illustrate the motion of the air plenum in operation.
Figure 17:
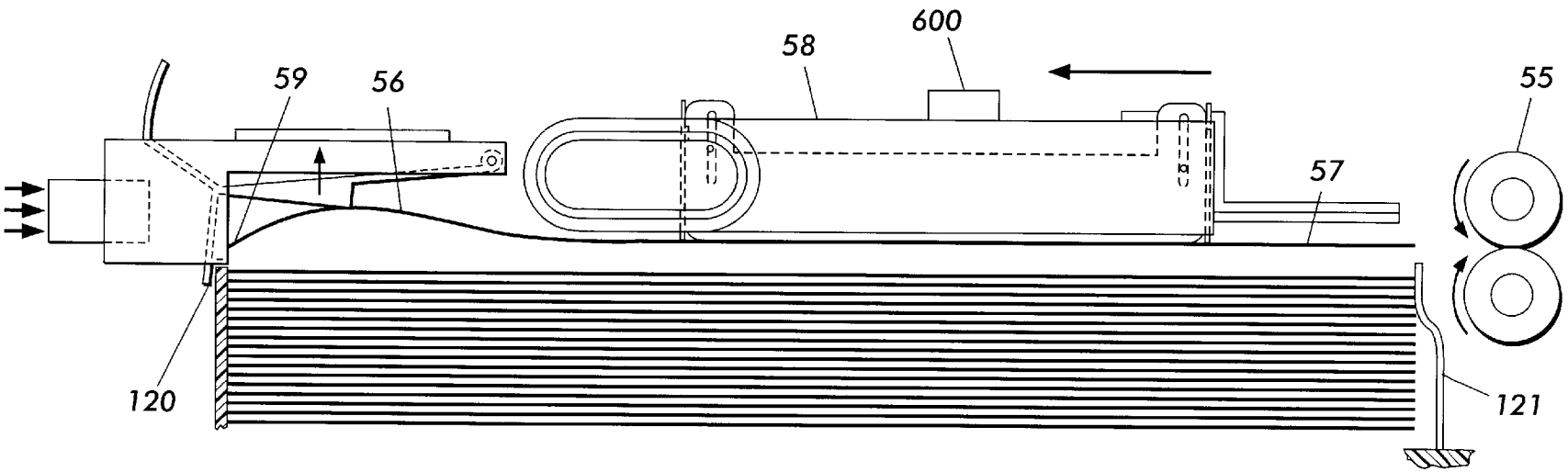
Figure 18:
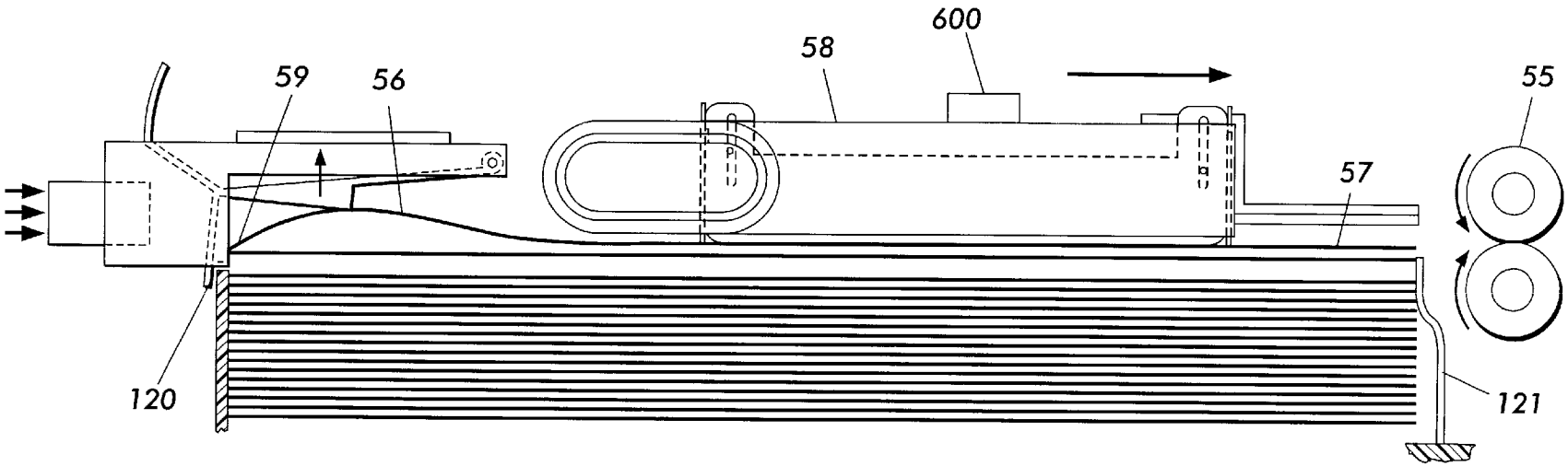

Referring FIGS. 16 through 18 drive assembly 600 is, attached to air plenum 58 for translating the acquire sheet's leading edge 57 into feed rollers. To further reduce the likelihood of removing other sheets from the stack (i.e., to reduce multi-feeds), onto vacuum paper contact surface 122, the drive assembly 600 translate the air plenum 58 initially in a reverse direction of movement of the feed rollers 55 so that a trailing edge 59 of the acquired sheets abuts against a portion 120 of the sheet tray to generate a buckle area in the acquired sheet. Then, drive assembly translates air plenum in a direction of movement of the feed rollers 55 so that a lead edge of the acquired by the feed rollers 55 above flange 121. The drive assembly is shown in FIG. 17. Applicants have found that the reverse motion buckles sheet 56 and cause a force to separate sheet 56 from a bottom sheet if the two sheets are stuck together.

To further reduce the likelihood of removing other sheets from the stack (i.e., to reduce multi-feeds), onto vacuum paper contact surface 122 employs a corrugated surface composed of a combination of variant sized ribs to reduce the bonding forces between paper surfaces thereby separating sheets on said vacuum paper contact surface 122.

Figure 6:
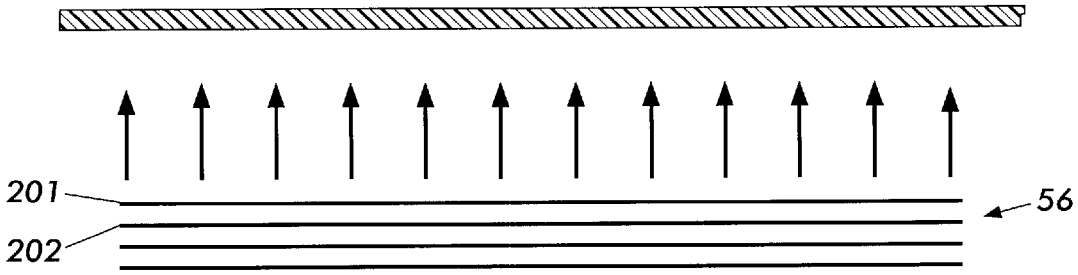
FIGS. 6 through 11 illustrate an air plenum acquiring sheets from a stack.
Figure 7:
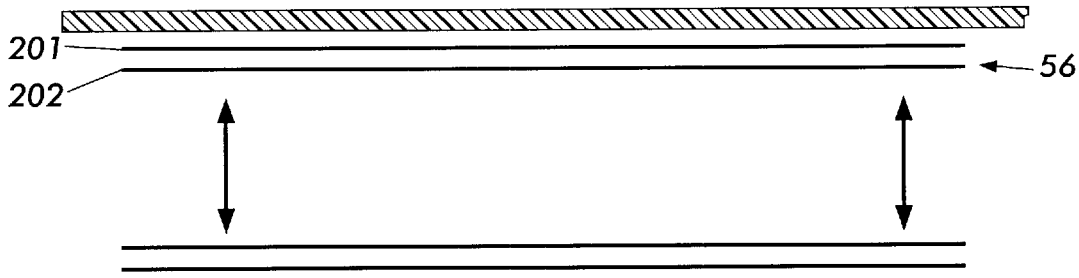

Applicants have found that there are bonding forces between paper surfaces, either due to vacuum, electrostatic, or edge wedding forces or other sources. In a vacuum feeder, to separate one sheet of paper from another, air is blown into the space between multiply acquired sheet surfaces, so that there are essentially two steps in sheet separation in a vacuum feeder: one is to generate gap and the other to blow air into the gap. The latter function is performed by air knives. We have long found that, without a corrugator, applying only a uniform vacuum to pull sheets apart is very unreliable (FIG. 6). As we can see in FIG. 7, the only force component to break the paper bond is the normal stress equal to the applied vacuum, and the paper will not be acquired until the vacuum breaks the weakest paper bond among the sheets. If the bond between the first sheet 201 and second sheet 202 is not the weakest, more than one sheet of paper will be acquired. If more than one sheet of paper is indeed acquired to the flat vacuum paper contact surface, a serious problem occurs because, as shown in FIG. 7, there is no meaningful force to separate the sheets acquired (except gravity, which will not guarantee a sheet separation). To break up the paper bond to initiate gaps, we would like to have some kind of high stress acting on the paper surfaces, and in FIG. 6, the vacuum force does not generate enough of a high stress on the surface.

We can draw at least one conclusion from this example, i.e., an evenly distributed pulling force will not be enough to ensure a sheet separation, and to effectively initiate gaps between sheets, some concentrated forces which result in highly concentrated stresses are desired.

Figure 8:
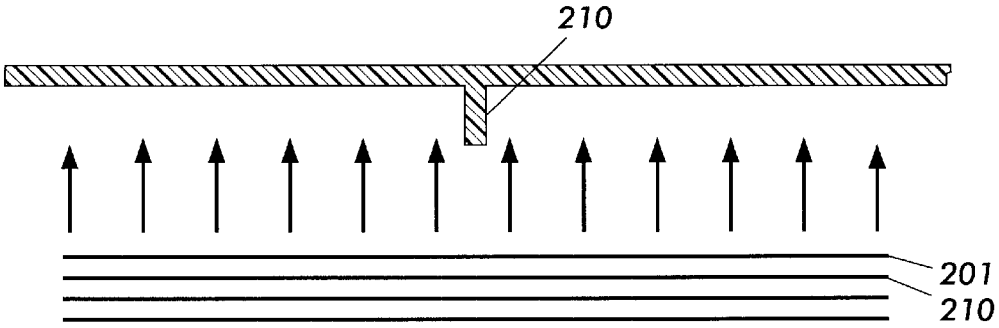
Figure 9:
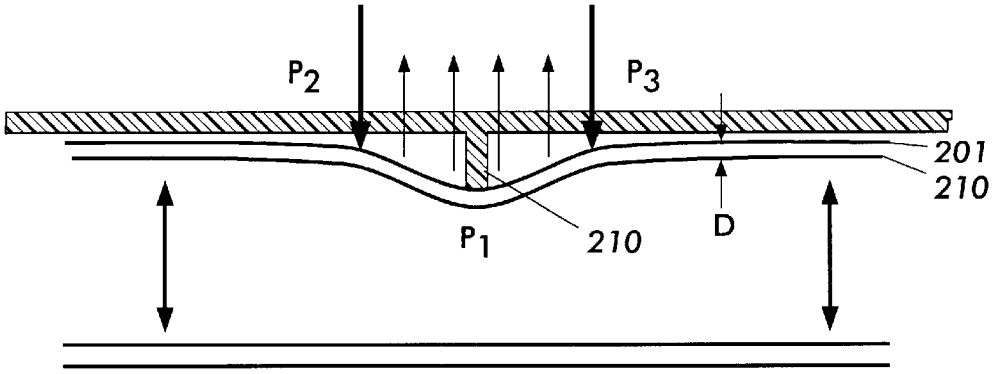

When paper is acquired (FIGS. 8 and 9), three concentrated shear forces, $P_1$, $P_2$ and $P_3$, will be generated due to corrugator 210 and these forces will produce shear stress over the cross-section of the paper along the paper thickness direction. As pointed out in the elasticity theory, the shear stress in the vertical direction (the paper thickness direction) will be equivalent to the shear stress in the horizontal direction (along the sheet surface); the shear stress at the center of the beam thickness will be the highest and its value will be inversely proportional to the thickness. Because the beam thickness of the acquired sheets is small, a concentrated shear force, will generate a large shear stress. Thus, if more than one sheet of paper is acquired (FIG. 9), the high shear stress will attempt to slide one sheet of paper over the other along the paper surface. A gap between sheets is therefore initiated if the strength of the paper bond at those stressed locations is weaker than the sliding force.

Besides shear force, the paper bending also helps initiate gaps between the paper. When a beam is bent, the upper and lower parts of the beam undergo different kinds of deformation: One part is in extension and the other in compression. Therefore, if more than one sheet of paper is bent simultaneously, the bending motion will help the sheet separation.

In addition to the sheet separation, the corrugator in the VCF also helps the paper transportation because a sheet of corrugated paper is much stiffer than a sheet of flat paper, making the sheets much easier to handle as sheet are transported to feed rollers 55.

Traditional top VCF's use one single straight rib as the corrugator to generate gaps. The vacuum required is about 60 $mmH_2O$ and air flow rate to ensure the generation of the required vacuum (and to produce sufficient fluffer and air knife flow) is about 50 cm. To meet these requirements, the air blower must be large. It requires a high powered motor and it is a major contributor to copier and printer noise. Besides that, a higher vacuum may tend to leave marks on the paper surface, a consequence not welcomed on coated paper.

While the VCF's like this perform well at sheet separation for a range of paper, the single rib corrugator performs poorly outside that range. In the color and offset printing market, the paper properties that must be handled vary greatly. So improving the latitude and reducing the expense of paper feeders is one of the objective of the present invention.

Figure 3:
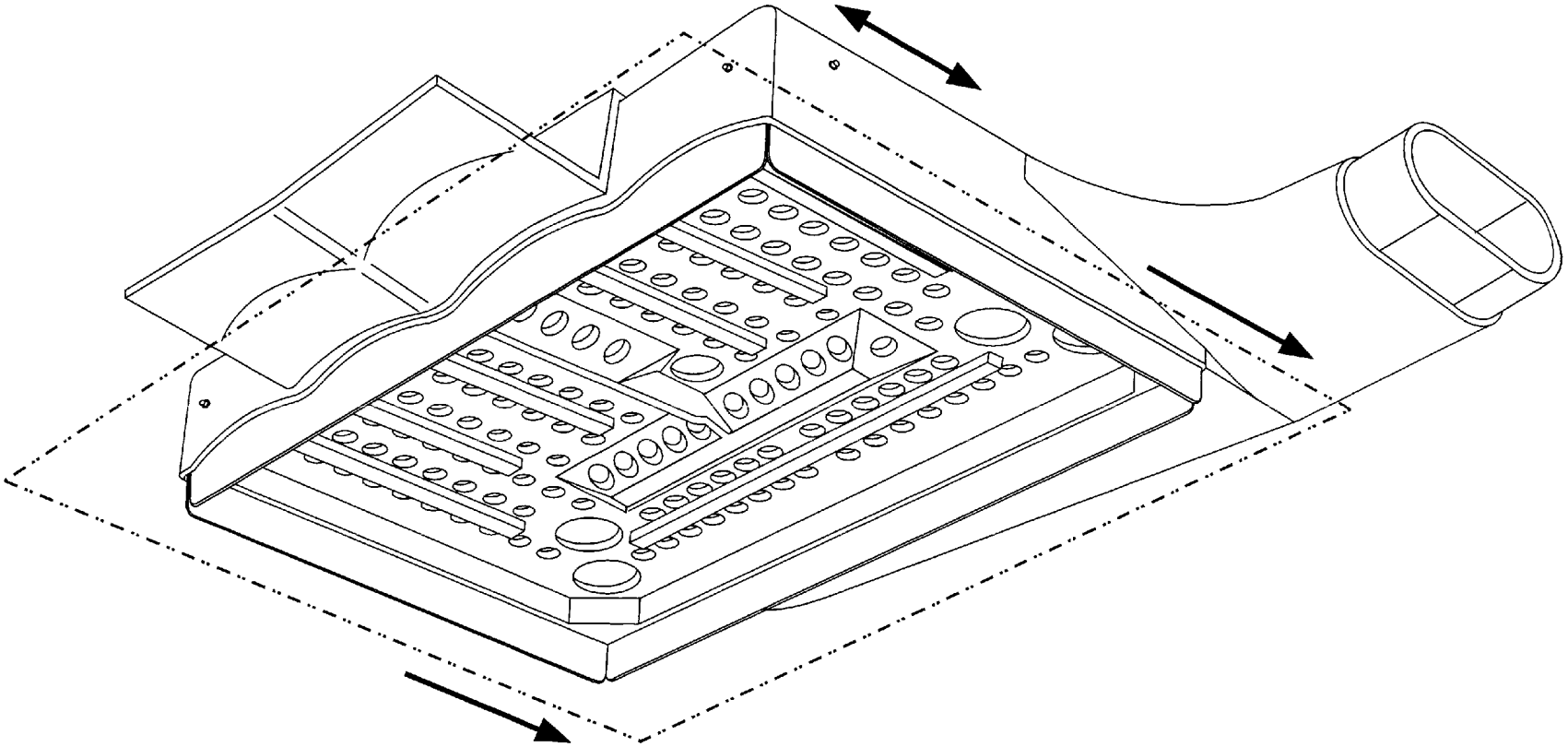
Figure 10:
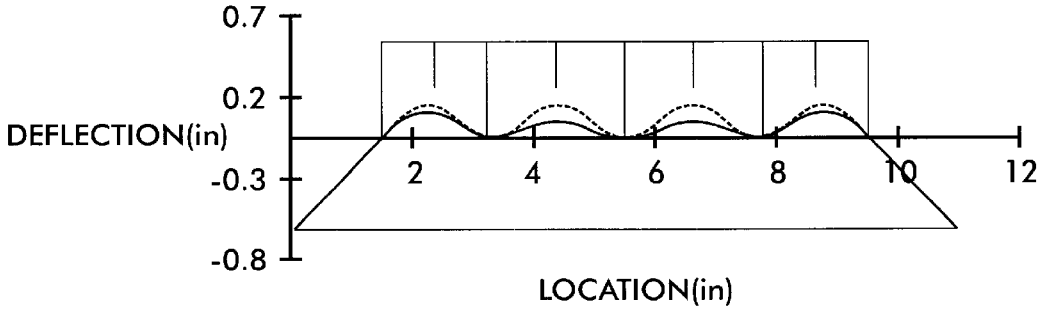
Figure 11:
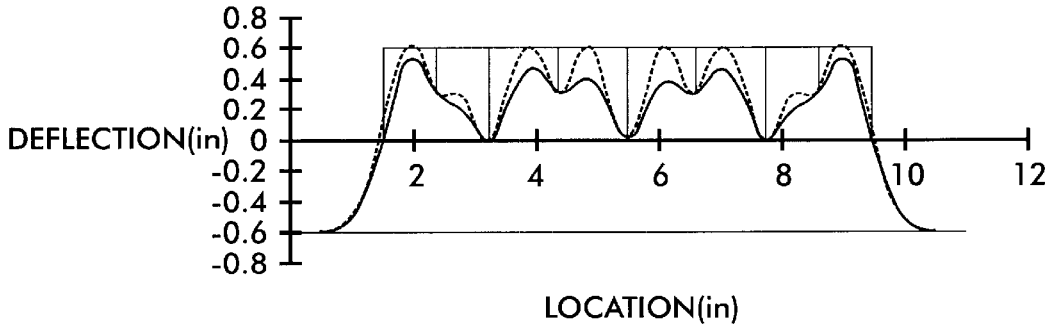
Figure 12:
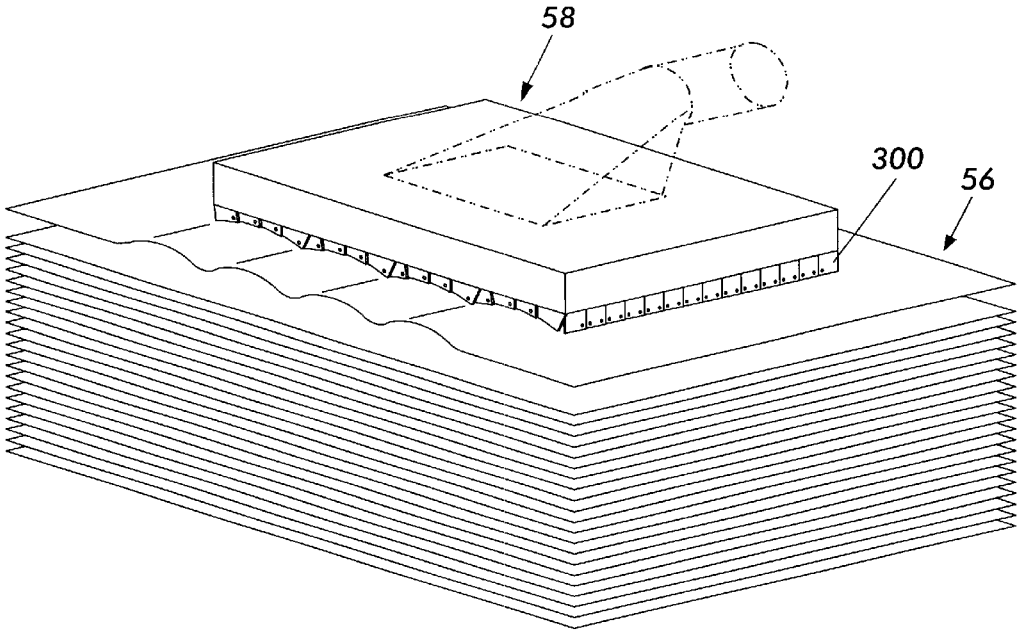
FIGS. 12 and 13 illustrate an embodiment of a seal used with the air plenum.

The MVCF corrugator consists of a number of variant-height ribs (FIGS. 3, 10, and 11). As is well known, heavyweight paper deflects less than lightweight paper because of the different bending stiffness. When bent over a rib, the second sheet of paper will follow the first more closely with lightweight paper, i.e., if an identical rib is used, less gap will be generated in the lightweight paper than in the heavyweight paper. Using these features, we can put a number of multiple-sized ribs in one VCF as shown in FIGS. 3, 10, and 11. When a vacuum is applied, the heavyweight paper is engaged with only the higher ribs and the lightweight paper will make contact with both the higher and the lower ribs. Note that only when a rib makes contact with the paper will shear forces be generated to perform the sheet separation. Because there are more ribs engaged with lightweight paper than with heavyweight paper, and because one rib will generate bigger gaps in the heavyweight paper than in the lightweight paper, the total gap area will approximately be equal for both the lightweight and the heavyweight paper in the MVCF. Without using high ribs, which produce a high bending stress and leave marks on the paper surface, MVCF can feed both stiff and flexible paper. This corrugator was composed of ribs of four different heights. The four side ribs (two on each side) were the tallest, and the two center ribs were the second tallest. If we apply the same amount of load, the heavyweight paper deforms less than the lightweight paper so that if we use the proposed corrugator, the paper will deform into one, two, four, six, and other numbers of spans depending on the paper stiffness.

FIG. 10 illustrates the paper deformation when the proposed corrugator was used to acquire heavyweight paper. FIG. 11 shows the deformed paper curvature when lightweight paper is acquired. The range of paper was from 60 GSM to 300 GSM. Comparing FIGS. 10 and- 11 with FIGS. 8 and 9, we found the proposed corrugator generated bending and sliding motions on most parts of the corrugator surface for all grades of paper; while for the heavyweight paper the single corrugator feeder generated the sliding motion only in the center part of the corrugator. Since both the sliding and bending motions are essential in the sheet separation, we believe the proposed corrugator should perform better.

Other embodiments and modifications of the present invention may occur to those skilled in the art subsequent to a review of the information presented herein; these embodiments and modifications, as well as equivalents thereof, are also included within the scope of this invention.

What is claimed is:

1. A sheet feeding apparatus for feeding a compilation of sheets in a direction of movement to a process station, comprising:

a sheet tray for holding said compilation of sheets;

an air plenum, positioned above said compilation of sheets, for picking up sheets into contact with said air plenum when a vacuum force is applied;

drive means, attached to said air plenum, for translating said air plenum initially in a direction reverse from the direction of movement so that a trailing edge of said one of said compilation of sheets abuts against a portion of said sheet tray to generate a buckle area in said one of said compilation of sheets thereby allowing separation of one of said compilation of sheets from other sheets in said compilation of sheets, and said drive means translates said one of said compilation of sheets in said direction of movement.

2. A method for feeding a compilation of sheets in a direction of movement to a process station, comprising steps of:

holding said compilation of sheets in a sheet tray;

picking up one of said compilation of sheets with air plenum; translating said air plenum initially in a direction reverse from the direction of movement so that a trailing edge said one of said compilation of sheets abuts against a portion of said sheet tray to generate a buckle area in said one of said compilation thereby allowing separation of said one of said compilation of sheets from other sheets in said compilation of sheets, and translating said one of said compilation of sheets in said direction of movement.

* * * * *